US008056738B2

(12) United States Patent
Phillips

(10) Patent No.: US 8,056,738 B2
(45) Date of Patent: Nov. 15, 2011

(54) DISPLAY UNIT

(75) Inventor: David Frank Arthur Phillips, Market Harborough (GB)

(73) Assignee: Michael Sheridan & Company Limited, Leicestershire (GB)

( * ) Notice: Subject to any disclaimer, the term of this patent is extended or adjusted under 35 U.S.C. 154(b) by 848 days.

(21) Appl. No.: 12/052,862

(22) Filed: Mar. 21, 2008

(65) Prior Publication Data

US 2008/0257839 A1 Oct. 23, 2008

(51) Int. Cl.
*A47G 29/00* (2006.01)

(52) U.S. Cl. ..... 211/85.26

(58) Field of Classification Search ..... 211/85.26, 211/134, 26, 13.1; 221/1, 2; 340/568.1; 174/58, 60

See application file for complete search history.

(56) References Cited

U.S. PATENT DOCUMENTS 5,305,183 A * 4/1994 Teynor ..... 361/679.55
6,205,398 B1 * 3/2001 Kobayashi et al. ..... 701/209
6,729,482 B1 * 5/2004 Hovik ..... 211/121
7,173,185 B1 * 2/2007 Cloran et al. ..... 174/58
7,233,241 B2 * 6/2007 Overhultz et al. ..... 340/539.2
7,445,126 B2 * 11/2008 Wilson et al. ..... 211/1.51
7,458,469 B2 * 12/2008 Hosaka et al. ..... 211/41.18
7,549,925 B2 * 6/2009 Scholen et al. ..... 463/46
7,599,516 B2 * 10/2009 Limer et al. ..... 382/100
7,724,135 B2 * 5/2010 Rapp et al. ..... 340/568.1
7,755,904 B2 * 7/2010 Wu et al. ..... 361/727
2004/0044580 A1 3/2004 Haller
2005/0040123 A1 * 2/2005 Ali ..... 211/59.3
2006/0213842 A1 * 9/2006 Shani et al. ..... 211/1
2007/0186515 A1 * 8/2007 Ruetten et al. ..... 53/502
2008/0121599 A1 * 5/2008 Korse ..... 211/134
2008/0149656 A1 * 6/2008 Yuyama et al. ..... 221/2
2008/0230497 A1 * 9/2008 Strickland et al. ..... 211/26
2008/0252414 A1 * 10/2008 Crigger et al. ..... 340/5.52
2008/0257839 A1 * 10/2008 Phillips ..... 211/49.1
2009/0050591 A1 * 2/2009 Hart et al. ..... 211/162
2009/0076650 A1 * 3/2009 Faes ..... 700/232
2009/0124015 A1 * 5/2009 Dussi et al. ..... 436/43

* cited by examiner

*Primary Examiner* — Sarah Purol
(74) *Attorney, Agent, or Firm* — Fulwider Patton LLP

(57) ABSTRACT

A display unit for displaying articles comprising a display portion for displaying a plurality of articles, sensing means for sensing the presence of each article and generating a response signal in response to removal of one of said articles by a consumer, and integral output means. The response signal is dependent on the article removed. The output means is configured for providing information directly to a consumer. The information is dependent on the article removed, the response signal being configured to initiate output of the information to said consumer.

19 Claims, 3 Drawing Sheets

DISPLAY UNIT

The present invention relates to a display unit for displaying articles.

The importance of high quality product displays in the sales environments is well understood. Product displays are particularly important in the cosmetics industry where customers often require an opportunity to handle and/or test a particular product, and to be given relevant information relating to the product by sales staff. However, in busy shopping environments, sales personnel frequently do not have the time to deal with all the customers requiring information, thus resulting in an associated loss of sales.

The importance of marketing information regarding customer interest in particular products is also well understood. Of particular interest to market researchers is information relating to customer interest in products, and whether or not that interest is converted into sales. Such information can be used, for example, for product targeting, assessing the quality of advertising or promotional information, or other similar purposes. However, whilst sales information is relatively easy to collate by analysing till receipts, information relating to customer interest is notoriously difficult to assess.

The present invention relates to a display unit, which mitigates the above issues.

According to one aspect of the present invention there is provided a display unit for displaying articles comprising: a display portion for displaying a plurality of articles; and means for sensing the presence of each article and generating a response signal in response to removal of one of said articles, said signal being dependent on the article removed.

Preferably each article is provided with an associated identifier tag, and wherein said sensing means is configured to sense the presence of said identifier tag, thereby sensing the presence of said article.

Each tag may be RFID tag.

Preferably the display unit further comprises output means for providing information specific to the article, said response signal being configured to initiate an output from said output means.

The output means may comprise visual display means for providing a visual output.

The output means may comprise audio output means for providing an audible output.

Preferably the display unit further comprises storage means, said response signal being configured to initiate storage of data in said storage means, in dependence on which article has been removed.

Preferably said data includes information relating to the usage of each article.

Preferably said usage data includes a count of the number of times each article is removed.

Preferably said usage data includes a measure of the time each article is removed for.

Preferably said usage data includes a measure of the average time for which an article is removed.

Preferably said usage data includes cumulative data acquired over a predetermined time period.

According to a further aspect of the present invention there is provided a display unit for displaying articles comprising: a display portion for displaying a plurality of articles; sensing means for sensing the presence of each article and generating a response signal in response to removal of one of said articles by a consumer, said signal being dependent on the article removed; and integral output means configured for providing information directly to a consumer, said information being dependent on the article removed; wherein said response signal is configured to initiate output of said information to said consumer.

According to a further aspect of the present invention there is provided a display unit for displaying articles comprising: a display portion for displaying a plurality of articles; sensing means for sensing the presence of each article and generating a response signal in response to removal of one of said articles by a consumer, said signal being dependent on the article removed; and storage means, said response signal being configured to initiate storage of data in said storage means, in dependence on which article has been removed; wherein said data includes information relating to the usage of each article, including a count of the number of times each article is removed.

Said information may be related to the article removed. It may also be unique to the article removed.

According to a further aspect of the present invention there is provided a display unit for displaying articles comprising: a display portion for displaying a plurality of articles; sensing means for sensing the presence of each article and generating a response signal in response to removal of one of said articles by a consumer, said signal being dependent on the article removed; and storage means, said response signal being configured to initiate storage of data in said storage means, in dependence on which article has been removed; wherein said data includes information relating to the usage of each article, including a measure of the time each article is removed for.

The invention will now be described with reference to the attached figures in which.

Figure 1:
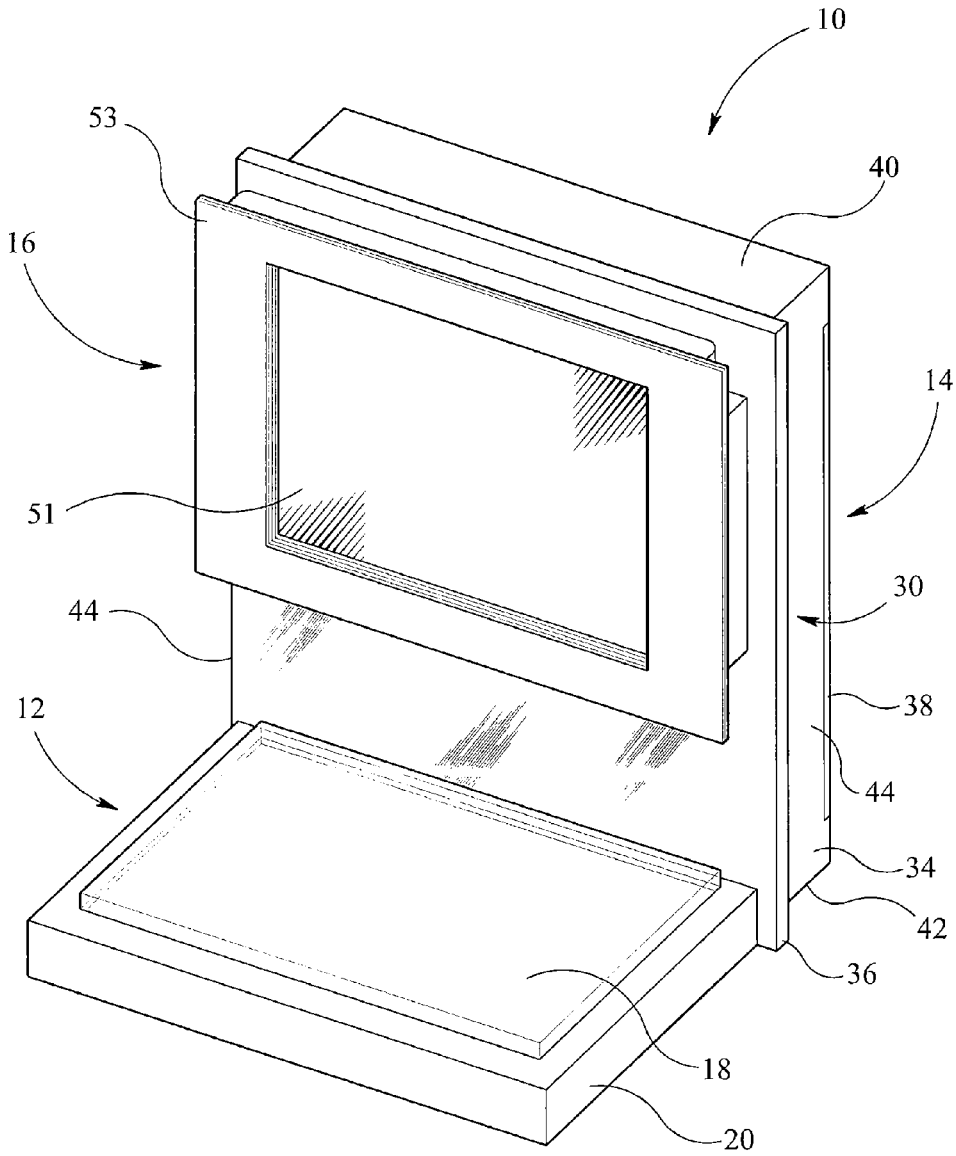
FIG. 1 is a three dimensional perspective view of a display unit according to the invention.
Figure 2:
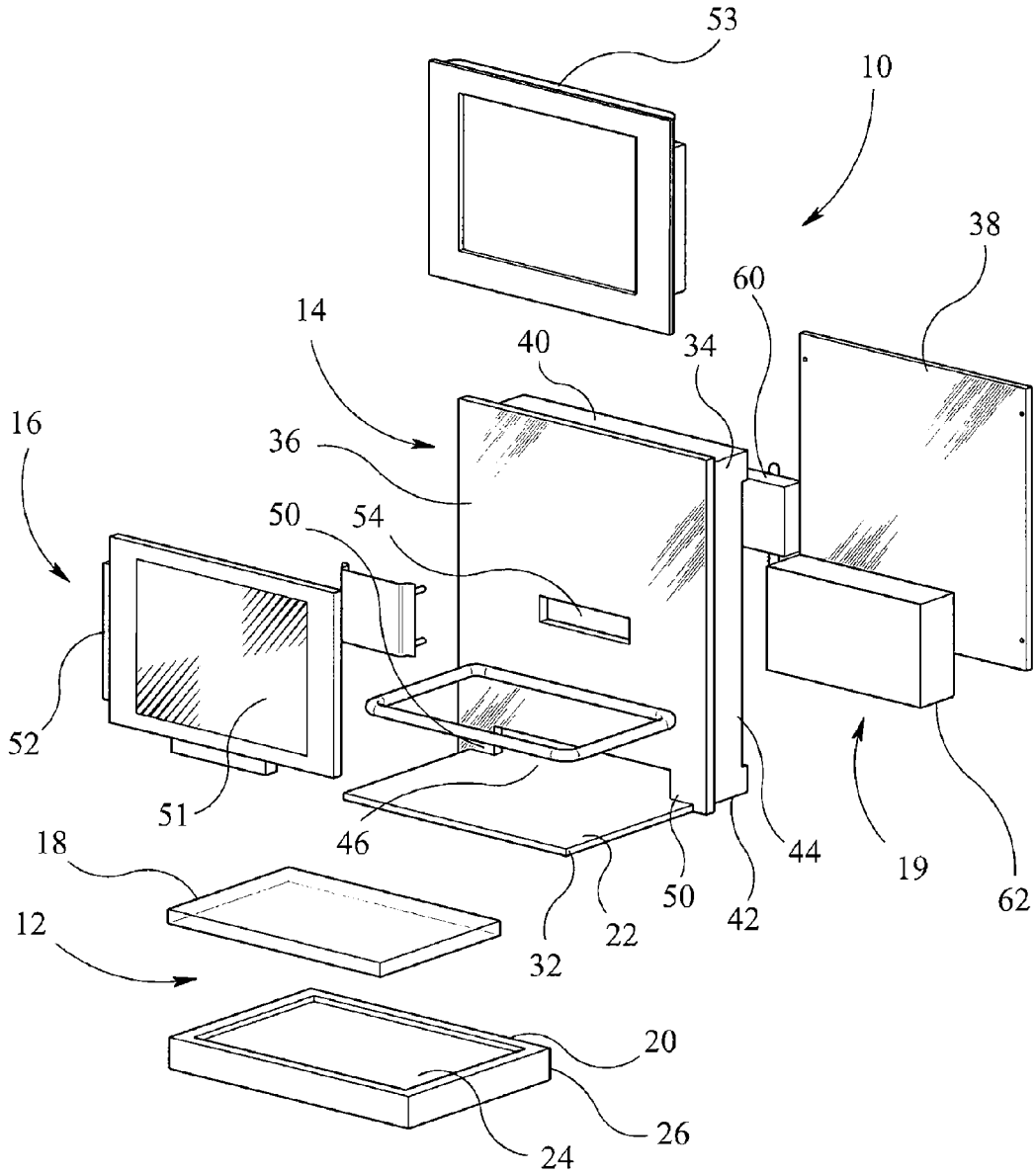
FIG. 2 is a three dimensional exploded view of the display unit according to FIG. 1.

In FIGS. 1 and 2 a display unit is shown generally at 10, the display unit comprises a display portion 12, a support portion 14, an information output portion 16, and a control portion 19.

The display portion 12 comprises as display plate 18, a base portion 20 and an antenna 22.

The display plate 18 is rectangular, although it will be appreciated that any suitable shape could be used for a different aesthetic appeal or the like. The display plate 18 may be made of any suitable material but typically comprises a polished clear acrylic or the like.

The base portion 20 is a hollow generally box shaped structure comprising an external surface having a recess 24 configured to receive the display plate 18, and an open side 26 providing access to the inside of the base portion 20, into which the antenna 22 is received when assembled.

The antenna 22 is configured for transmitting a signal suitable for the activation of a passive radio frequency identification (RFID) tag, and for receiving the associated return identification signal. The antenna 22 is located internally within the base portion 20, via the open side 26, and is shaped and positioned for detecting RFID tags placed on or within the vicinity of the display plate 18.

The support portion 14 comprises a housing 30, and a base support 32. The housing 30 is configured to house the control portion 19, and comprises a hollow generally box shaped structure having, a carcass 34, a front panel 36, and a rear panel 38.

The carcass 34 comprises upper, lower, and two longitudinal sidewalls 40,42,44 arranged to form a frame having a generally rectangular perimeter. The rear panel 38 is configured for removable engagement with a rear of the frame 34, for providing access to the inside of the housing 30. The front panel 36 is fixed to a front of the frame 34 for providing support for the display portion 12.

The base support 32 is generally planar and extends outwardly from the lower sidewall 42, beyond the front panel 36. The base support 32 is configured for supporting the base portion 12 when the unit is assembled. The front panel 34 is provided with an inset portion. The inset portion being arranged with the base support 32 to form a base aperture 46, for providing access to the base portion 20. The aperture 46 is configured for mutual engagement with a corresponding part of the base portion 20, when the unit is assembled.

The carcass 34 further comprises a plurality of connection points 50 for interconnection of the antenna 22 to equipment housed in the housing 30. The connection points 50 are arranged to protrude into the base aperture 46, although it will be appreciated that the connection points could comprise sockets into which corresponding plugs on the antenna fitted.

The information output portion 16 comprises a visual display unit 51 such as a conventional thin film transistor computer display monitor or the like, and associated audio output device comprising speakers 52. The unit 16 is provided with a surround 53 for protecting the screen during use. It will be appreciated, however, that the information output portion 16 may alternatively or additionally comprise other forms of information output device, for example, video or dvd players, separate audio devices, or other forms of visual displays such as liquid crystal message displays or the like.

The front panel 34 is further provided with a cable aperture 54 arranged to provide power and data cable access to the information output portion 16 from within the housing 30.

The control portion 19 comprises a communication portion 60 and a controller board 62 located within the housing 30.

The communication portion 60 interfaces with the antenna 22 and comprises a receiver for receiving and modulating the RF identification signals picked up by the antenna 22. The controller board 62 interfaces with both the communication portion 60 and the information output portion, and is configured to monitor the modulated signals substantially continuously, to interpret the monitored signals, and to identify any tags present on or within the vicinity of the display plate 18. The controller board 62 is further configured to distinguish between signals associated with different RF tags, if present, thereby to determine if any tags have been removed from or placed on the display plate 18, and where appropriate to issue a response signal in dependence on which tags are present and/or have been removed.

The communication portion 60 is further configured to issue the activation signal, via the antenna 22, to activate any RFID tags on or in the vicinity of the display plate 18, thereby initiating transmission of the associated identification signals.

The controller board is provided with anti-collision functionality, configured to differentiate between multiple tags simultaneously removed and/or placed on or within the vicinity of the display plate 18.

It will be appreciated that the controller board may form part of a conventional computer or the like, the computer being programmed to interpret and manipulate data received via the antenna and communication portion.

Figure 3:
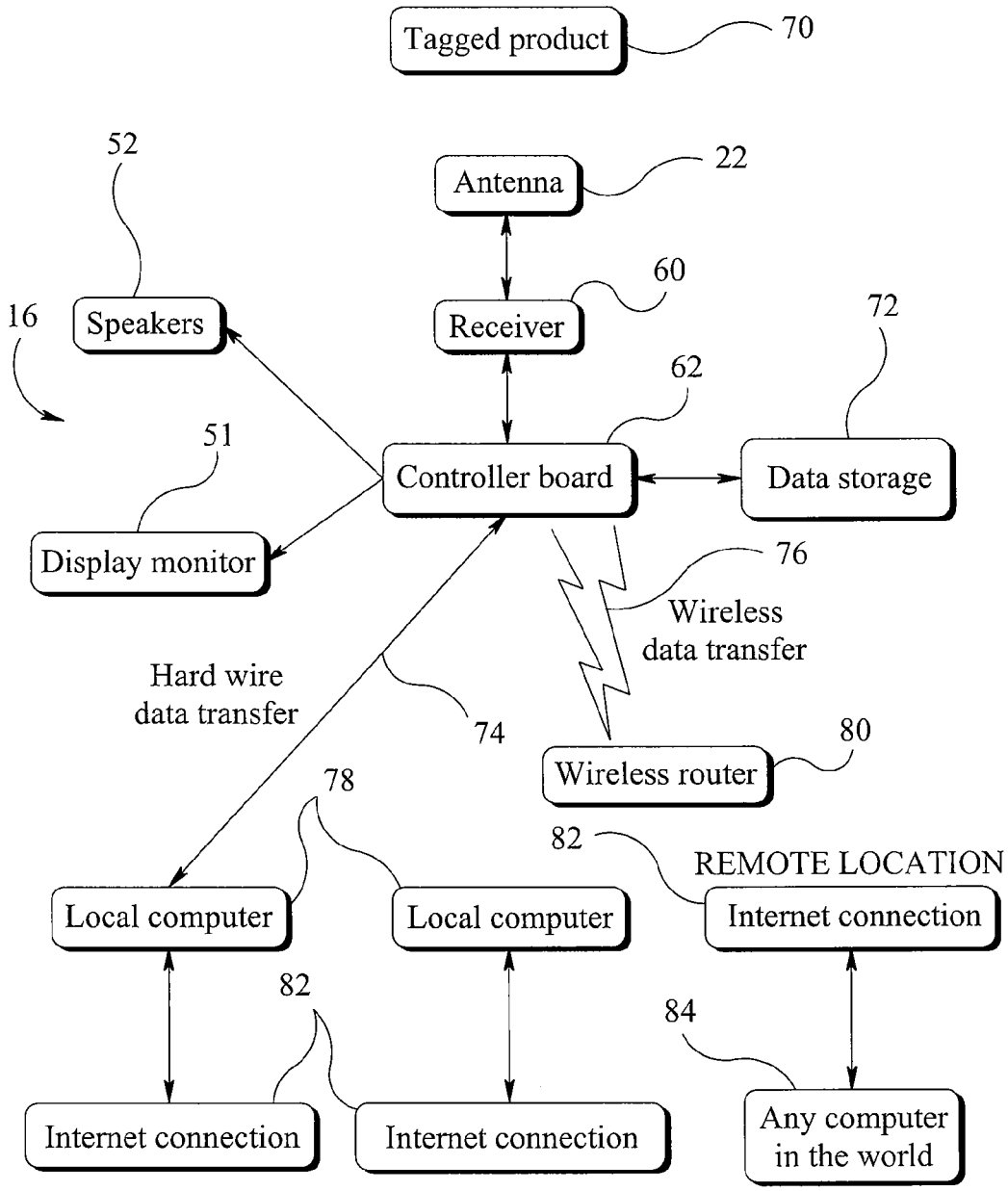
FIG. 3 is a system overview of the display unit according to FIG. 1.

The operation and functionality of the display unit 10 will now be further described, by way of example only, with reference to FIG. 3.

As seen in FIG. 3 the controller board 62 is provided with an associated data storage device 72. The data storage device 72 is configured for storing data required by the controller board both to enable identification of the tagged products 70 and to determine the appropriate response. Thus, in operation, the data storage device stores both information relating to the tagged products 70, and programmed software routines for information output and data logging.

In operation, a separate RFID tag (not shown) is fixed to each of a plurality of products 70 of different types. Each RFID tag is configured to issue a signal, in response to an activation signal, which uniquely identifies each product or product type. The controller board 62 is pre-programmed to recognise the unique RF identifiers associated with each tag, and to associate them with the corresponding product or type.

The tagged products 70 are placed on the display plate 18 of the display unit 10. The tags are activated by an activation signal transmitted via the antenna 22 and thus the antenna 22 receives corresponding RFID signals from the associated tags. The RF signals are modulated by the receiver of the communication portion 60, and monitored and interpreted by the controller board 62.

The controller board 62 identifies the tags, and hence the products present on the display plate 18, and responds accordingly. Where the mix of products on the display plate 18 remains the same the controller board responds simply either by maintaining the status quo, or by initiating output of a default routine via the information output portion. For example, a screen saver routine may be initiated or allowed to continue running on the information output portion, and/or appropriate musical output may be initiated or allowed to continue to play.

Where a tag has been removed or replaced, the response may be in any suitable form. Typically, for example, on removal of a tagged product the response will involve issuing a signal to initiate output of an information routine via the information output portion, the routine relating specifically to the tagged product that has been removed from or placed on the display plate 18. Alternatively or additionally, the response may include initiation of a data storage routine for logging removal or replacement of a particular product. The data storage routine could, for example, maintain a record of the cumulative and/or average length of time a particular product is removed from the display plate 18, and/or a count of the number of times it is removed. Similarly, the data could be accumulated over an appropriate period of time, for example, weekly, monthly, and/or annually or the like, thereby allowing appropriate marketing statistics to be collected.

On replacement of the tagged product the response will typically involve, for example, termination of any logging and/or output routine. Alternatively, an output routine could be allowed to continue till it finishes or until another product is removed from the display plate 18. Replacement of a product could also initiate another output routine thanking a customer for their interest or the like.

The product related information output routine may comprise any suitable marketing, technical or other output. Typically, for example, the output will include a product specific information such as a promotional video, technical information, sales information such as related special offers or the like, instructional information, and/or details of benefits of the product.

Where a plurality of products are removed or replaced simultaneously, the anti-collision functionality of the controller board determines which tagged products have been removed/replaced and issues a response in dependence on a set of pre-programmed priorities based on an appropriate criterion such as, for example, the popularity or value of the tagged products.

It will be appreciated that the information output portion 16 may be further provided with means for receiving a user input, for example a touch sensitive screen, keyboard, dedicated buttons or the like. Hence, the output routine may be interactive allowing a user, for example, to make selections, answer questions, and/or enter data etc. The routine may be configured to store information entered by the user for market or other research and may respond interactively according on the data entered or selections made.

The controller board 62 is further provided with interface means 74, 76, for interconnection with external local computers 78, either directly via a wired connection 74, or indirectly via a wireless router 80. The local computers 78 are configured to allow the controller board 62 to be programmed and reprogrammed locally. Reprogramming may be required, for example, to take account of changes in the identification of tagged products, such as the addition of new products, a change in the identification of an existing product, or the like. Alternatively, the reprogramming may be required to store new or to modify existing information output routines, and/or to modify the way in which usage data is logged.

The local computers 78 are further configured to allow interrogation of the data store 72 to retrieve any logged data relating to the tagged products 70, thereby allowing compilation, reporting, and presentation of usage statistics or the like. For example, the data could be used for market research, to assist in the formulation of predictions regarding future demand for a product, or the like. Thus, in operation a product display may be programmed, reprogrammed, or interrogated locally, for example, by a service engineer.

The local computers 78 are provided with access to a network 82, for example the internet, to allow programming and data access via remote computers 84 having access to the network 82. Thus, in operation a product display at one location, for example, in a shop, may be programmed, reprogrammed, or interrogated remotely via a computer in a different location, for example, a head office.

In typical operation, the display unit 10 is set up with a plurality of different tagged products in a location such as a point of sale in a shop. A customer interested in a particular tagged product picks it up from the display for closer inspection. This results in the initiation of an information output routine, by the controller board 62, which provides the customer with information relating to the selected product. The controller board 62 also logs the selection of the product in question in the data store 72 for future statistical analysis. Thus, customers are provided with potentially useful information, which may encourage purchase of a particular product, whilst useful marketing data is collected.

The invention claimed is:

1. A display unit for displaying articles comprising:

a display portion for displaying a plurality of articles, wherein each of the articles is provided with an associated identifier tag;

sensing means for sensing the presence of each of the articles and generating a response signal in response to removal from the display portion of one of said articles by a consumer, said signal being dependent on the article removed, wherein said sensing means is configured to sense the presence of each said associated identifier tag, thereby sensing the presence of each of the articles; and integral output means configured for providing information directly to a consumer, said information being dependent on the article removed;

wherein said response signal is configured to initiate output of said information to said consumer, such that a user is provided with information specific to the removed article upon removal of the article from the display portion.

2. A display unit for displaying articles comprising:

a display portion for displaying a plurality of articles, wherein each of the articles is provided with an associated identifier tag, and wherein each said associated identifier tag is an RFID tag;

sensing means for sensing the presence of each of the articles and generating a response signal in response to removal from the display portion of one of said articles by a consumer, said signal being dependent on the article removed, wherein said sensing means is configured to sense the presence of each said associated identifier tag, thereby sensing the presence of each of the articles; and integral output means configured for providing information directly to a consumer, said information being dependent on the article removed;

wherein said response signal is configured to initiate output of said information to said consumer, such that a user is provided with information specific to the removed article upon removal of the article from the display portion.

3. A display unit as claimed in claim 1 wherein said output means comprises visual display means configured for providing a visual output.

4. A display unit for displaying articles comprising:

a display portion for displaying a plurality of articles;

sensing means for sensing the presence of each of the articles and generating a response signal in response to removal from the display portion of one of said articles by a consumer, said signal being dependent on the article removed; and integral output means configured for providing information directly to a consumer, said information being dependent on the article removed, wherein said output means comprises audio output means configured for providing an audible output;

wherein said response signal is configured to initiate output of said information to the consumer, such that a user is provided with information specific to the removed article upon removal of the article from the display portion.

5. A display unit as claimed in claim 1 further comprising storage means, wherein said response signal is configured to initiate storage of data in said storage means, in dependence on which article has been removed.

6. A display unit as claimed in claim 5 wherein said data relates to the removal or replacement of each article.

7. A display unit for displaying articles comprising:

a display portion for displaying a plurality of articles;

sensing means for sensing the presence of each of the articles and generating a response signal in response to removal from the display portion of one of the articles by a consumer, said signal being dependent on the article removed;

counting means for counting the number of times each of the articles is removed to provide a count of the number of times each of the articles is removed;

storage means for storing data relating to the removal or replacement of each of the articles, wherein said response signal is configured to initiate storage of data in said storage means, in dependence on which of the articles has been removed, and wherein said data includes said count of the number of times each of the articles is removed; and integral output means configured for providing information directly to a consumer, said information being dependent on the article removed;

wherein said response signal is configured to initiate output of said information to the consumer, such that a user is provided with information specific to the removed article upon removal of the article from the display portion.

8. A display unit as claimed in claim 6, further comprising timing means for measuring a time for which each article is removed, and wherein said data includes a measure of the time for which each article is removed.

9. A display unit as claimed in claim 8, further comprising average time measurement means for determining an average time for which each article is removed, and wherein said data includes a measure of the average time for which an article is removed.

10. A display unit as claimed in claim 7 wherein said data includes cumulative data acquired over a predetermined time period.

11. A display unit as claimed in claim 8 wherein said data includes cumulative data acquired over a predetermined time period.

12. A display unit as claimed in claim 9 wherein said data includes cumulative data acquired over a predetermined time period.

13. A display unit as claimed in claim 7, further comprising timing means for measuring a time for which each article is removed, and wherein said data includes a measure of the time for which each article is removed.

14. A display unit as claimed in claim 2 wherein said output means comprises visual display means configured for providing a visual output.

15. A display unit as claimed in claim 1 wherein said output means comprises audio output means configured for providing an audible output.

16. A display unit as claimed in claim 2 wherein said output means comprises audio output means configured for providing an audible output.

17. A display unit as claimed in claim 2 further comprising storage means for storing data relating to the removal or replacement of each article, wherein said response signal is configured to initiate storage of data in said storage means, in dependence on which article has been removed.

18. A display unit as claimed in claim 3 further comprising storage means for storing data relating to the removal or replacement of each article, wherein said response signal is configured to initiate storage of data in said storage means, in dependence on which article has been removed.

19. A display unit as claimed in claim 4 further comprising storage means for storing data relating to the removal or replacement of each article, wherein said response signal is configured to initiate storage of data in said storage means, in dependence on which article has been removed.

* * * * *

UNITED STATES PATENT AND TRADEMARK OFFICE

CERTIFICATE OF CORRECTION

PATENT NO. : 8,056,738 B2
APPLICATION NO. : 12/052862
DATED : November 15, 2011
INVENTOR(S) : David Frank Arthur Phillips It is certified that error appears in the above-identified patent and that said Letters Patent is hereby corrected as shown below:

On the Title page, insert Item (30)
--(30) Foreign Application Priority Data
Sep. 22, 2005 (GB) 0519324--.

On the Title page, insert Item (60)
--(60) Related U.S. Application Data
Sep. 18, 2006..PCT/GB2006/003448--.

Signed and Sealed this
Seventh Day of August, 2012

David J. Kappos

David J. Kappos
*Director of the United States Patent and Trademark Office*